United States Patent [19]

Teeter et al.

[11] Patent Number: 5,056,803

[45] Date of Patent: Oct. 15, 1991

[54] AUTOMATICALLY RELEASING SKI BINDING

[75] Inventors: Roger C. Teeter; Lawrence C. Smith, both of Sumner, Wash.

[73] Assignee: STL International, Incorporated, Tacoma, Wash.

[21] Appl. No.: 394,701

[22] Filed: Aug. 16, 1989

Related U.S. Application Data

[63] Continuation-in-part of Ser. No. 169,789, Mar. 18, 1988.

[51] Int. Cl.[5] ..... A63C 9/08

[52] U.S. Cl. ..... 280/14.2; 280/617; 441/70

[58] Field of Search ..... 280/623, 607, 617, 618, 280/636, 809, 14.2, 634; 441/70

[56] References Cited

U.S. PATENT DOCUMENTS

| | | | |
|---|---|---|---|
| 3,731,328 | 5/1973 | Russell | 9/310 |
| 4,652,007 | 3/1987 | Dennis | 280/618 |

*Primary Examiner*—Andres Kashnikow
*Assistant Examiner*—Richard Camby
*Attorney, Agent, or Firm*—Robert W. Beach; Ward Brown

[57] ABSTRACT

A binding for two feet in tandem on one ski that includes a boot for holding the front foot having a detachable toe holder and a movable retainer secured to the ski between the two feet for holding the boot heel. A foot-engageable member for the rear foot holds the retainer forward when the rear foot is in position on the ski, and releases the retainer to free the boot should the rear foot be removed from the ski.

26 Claims, 14 Drawing Sheets

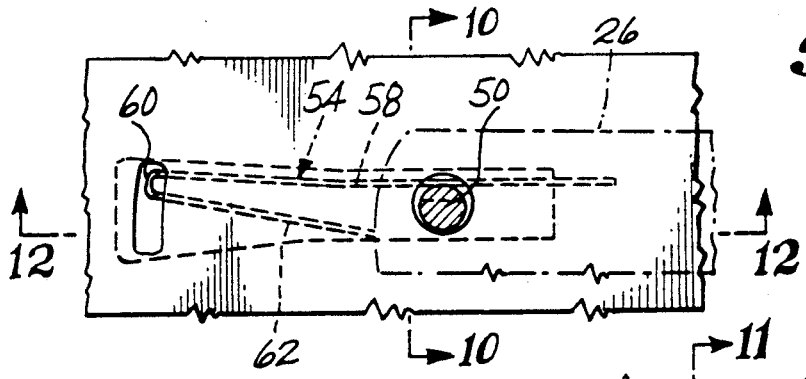
Fig. 8
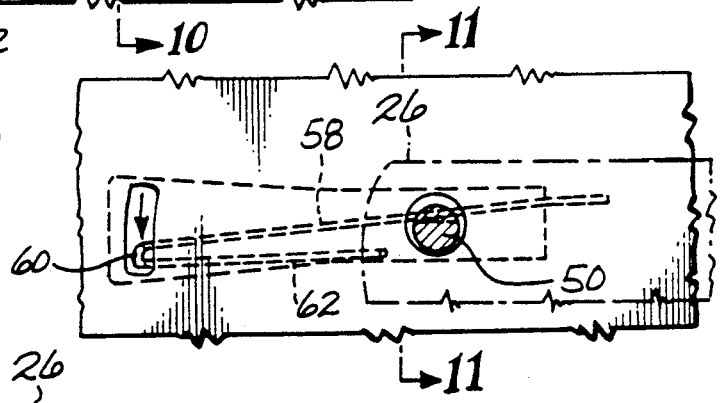
Fig. 9
Fig. 10
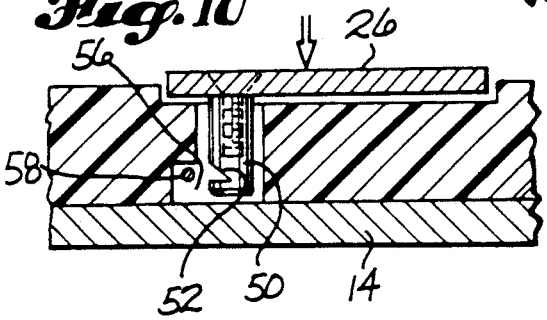
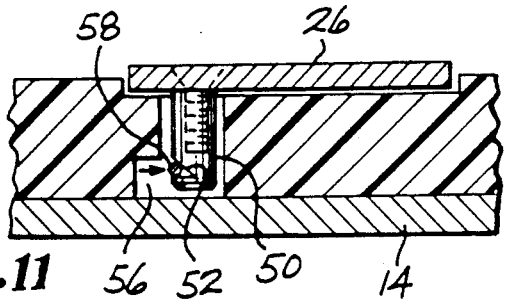
Fig. 11
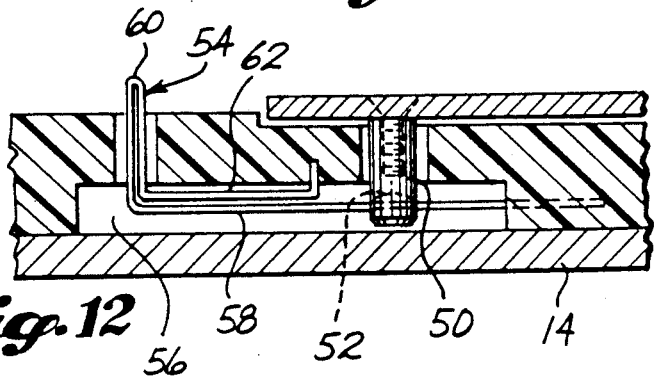
Fig. 12

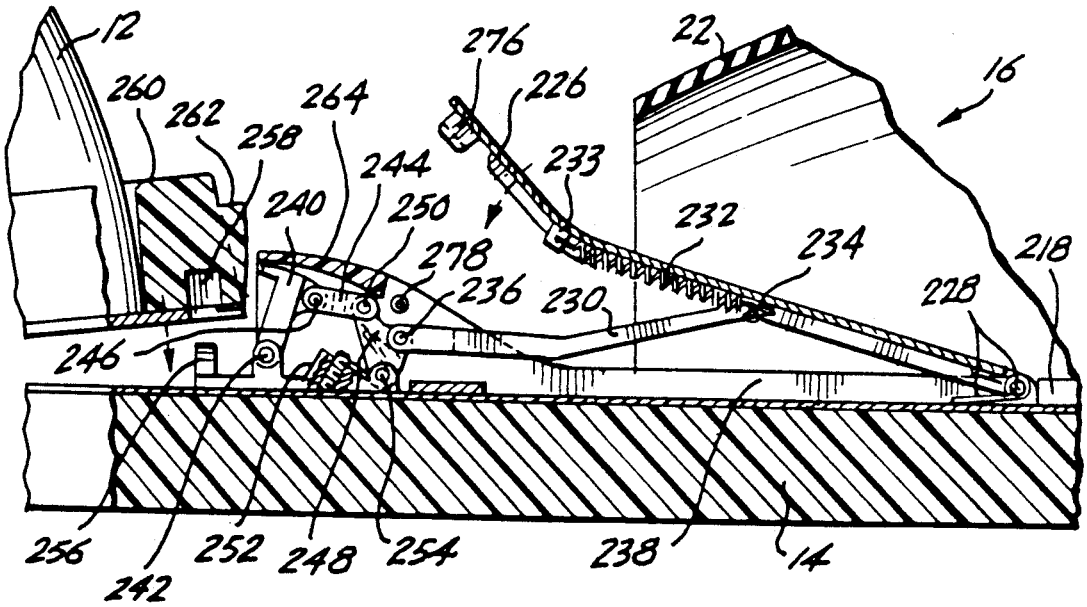
Fig. 29.
Fig. 31.
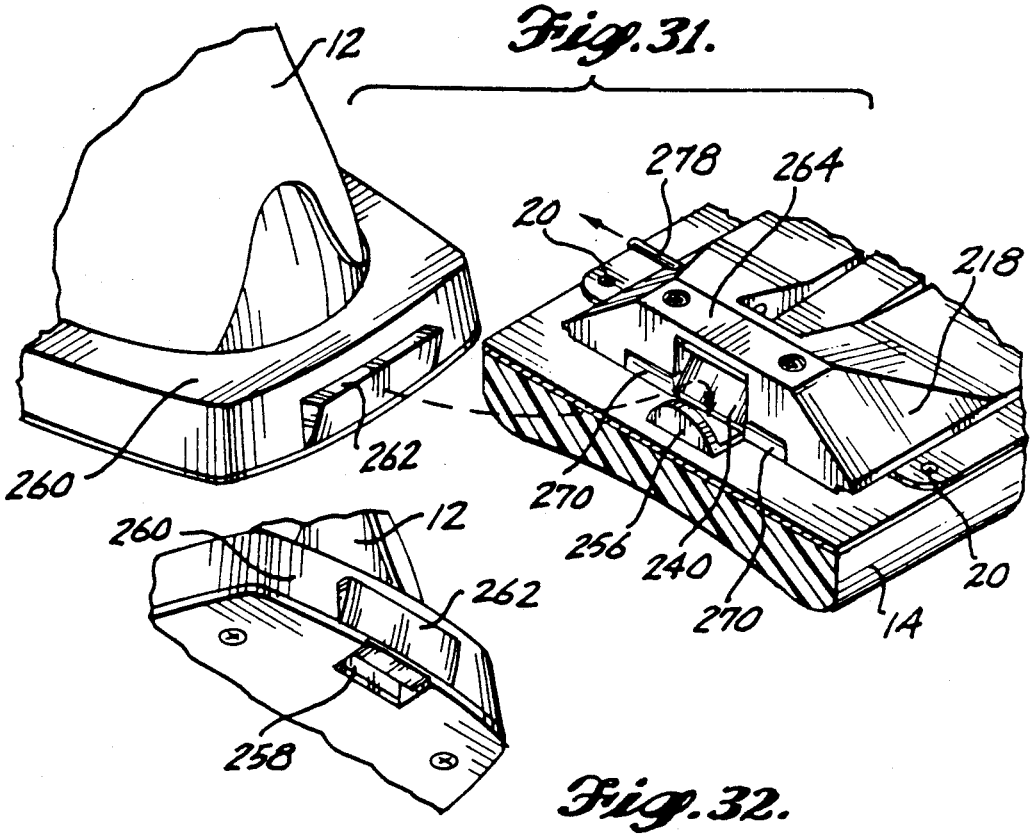
Fig. 32.

Fig. 30.
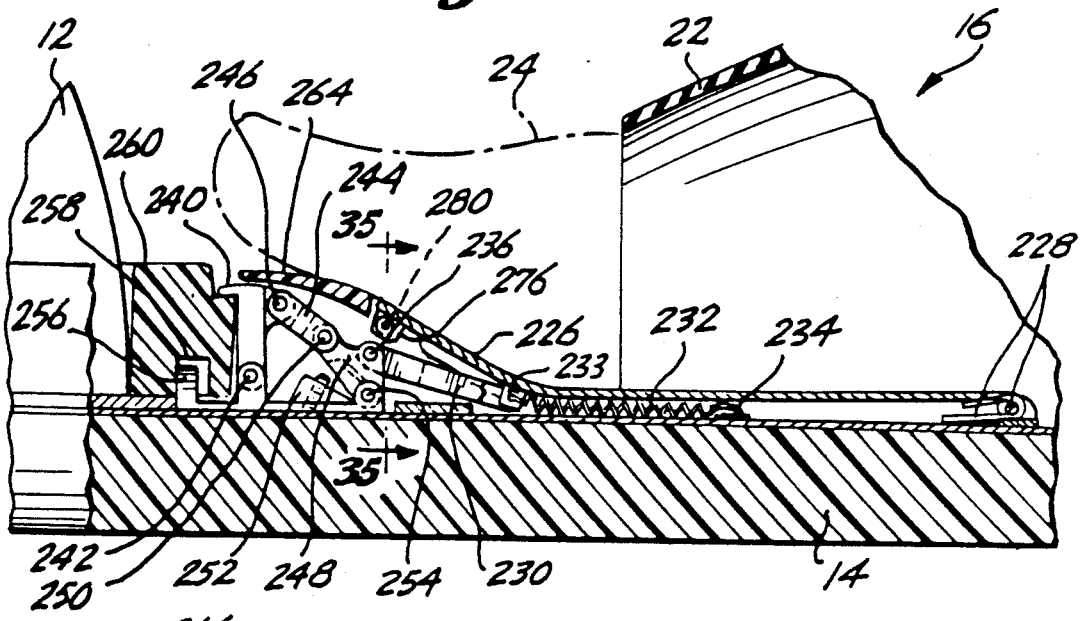
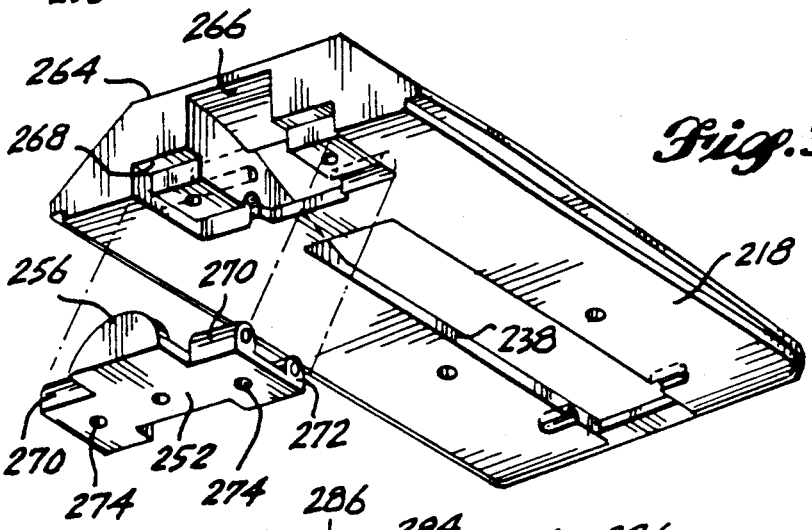
Fig. 34.
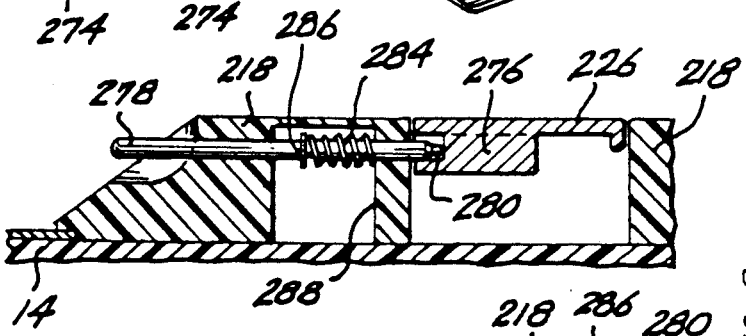
Fig. 35.
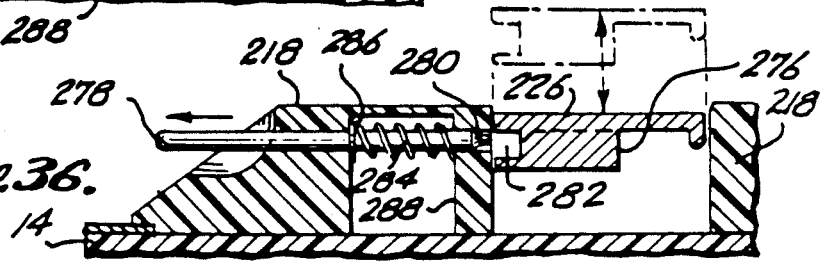
Fig. 36.

AUTOMATICALLY RELEASING SKI BINDING

CROSS REFERENCE

This application is a continuation-in-part of our copending U.S. application Ser. No. 169,789, filed Mar. 18, 1988, for Automatically Releasing Ski Binding.

BACKGROUND OF THE INVENTION

1. Field of the Invention

This invention relates to foot-retaining ski bindings for feet arranged in tandem, particularly on a single water ski.

2. Prior Art

When skiing one may use a single ski and place the feet on the ski in tandem arrangement, one foot behind the other. A water ski providing for such foot placement is shown in Russell U.S. Pat. No. 3,731,328, issued May 8, 1973.

It has been found that much better control of the ski is provided if at least the front foot is firmly held to the ski. If for any reason the skier falls, ordinarily his rear foot comes loose from the ski and his front foot remains attached to the ski, which could cause severe injury. When the front foot is held in a boot attached to the ski and the rear foot is simply held by an instep strap, the rear foot is usually pulled out of the strap when the skier falls and the front foot is still held by the boot to the ski. If the skier prefers to have both feet fitted in boots, then in a fall either boot could be freed from the ski first. If one boot were freed and the other boot remained attached to the ski, severe injury could result.

U.S. Pat. No. 4,652,007, Dennis, issued Mar. 24, 1987, for Releasable Binding System for Snowboarding discloses a binding for two feet on a snowboard constructed for automatic and simultaneous release of one foot when the other foot is released from the snowboard.

SUMMARY OF THE INVENTION

The principal object of this invention is to insure that where two feet are in tandem arrangement on the same ski, whenever one foot is separated from the ski the other foot is automatically released from the ski.

Specifically it is an object to provide release of the front foot from a ski should the rear foot be separated from the same ski.

It is another object to secure a front foot in place on a ski until the rear foot is retained on the same ski.

To accomplish the foregoing objects, a front boot is secured at the toe and the heel to a ski. The toe of the boot on the foot is inserted into a front hold-down and the boot heel is held by a movably mounted heel retainer kept in a forward position by a holding member located behind the heel retainer. When the rear foot is separated from the ski the holding member is released so that the front foot boot heel retainer is freed to move rearward and release the front foot boot from the ski. When the retainer for the rear foot is another boot, that boot has an excessive force release device holding the heel of that boot to the ski. When the rear foot retainer includes an instep strap secured to the ski a treadle under the strap is held depressed initially by a latch and subsequently by the ball of the rear foot to hold the front foot boot heel retainer forward, and such treadle is released if the foot is removed from beneath the strap to enable the front foot boot heel retainer holding member to release the front boot heel retainer.

DESCRIPTION OF THE DRAWINGS

FIG. 8 is a detailed plan of hold-down parts in position ready to be latched in place, and FIG. 9 is a corresponding view with parts in securing position.

FIG. 10 is a cross section taken along line 10—10 of FIG. 8, FIG. 11 is a cross section taken along line 11—11 of FIG. 9, and FIG. 12 is a longitudinal section taken along line 12—12 of FIG. 8.

FIG. 29 is an enlarged longitudinal section through the central portion of the invention shown in FIG. 26 with parts in one relationship, and FIG. 30 is a similar view with parts in a different relationship.

FIG. 31 is a top perspective view of portions of the third embodiment of the invention shown in FIGS. 29 and 30 with components shown in exploded relationship, and FIG. 32 is a bottom perspective view of one of the components shown in FIG. 31.

FIG. 34 is a bottom perspective view of a component of the third embodiment of the invention shown in FIGS. 29, 30 and 31 with parts shown in exploded relationship.

FIG. 35 is a detail transverse section through a portion of the mechanism of the third embodiment of the invention shown in FIGS. 29 and 30 with parts in latched relationship, and FIG. 36 is a similar view with parts shown in unlatched relationship.

DETAILED DESCRIPTION

Figure 1:
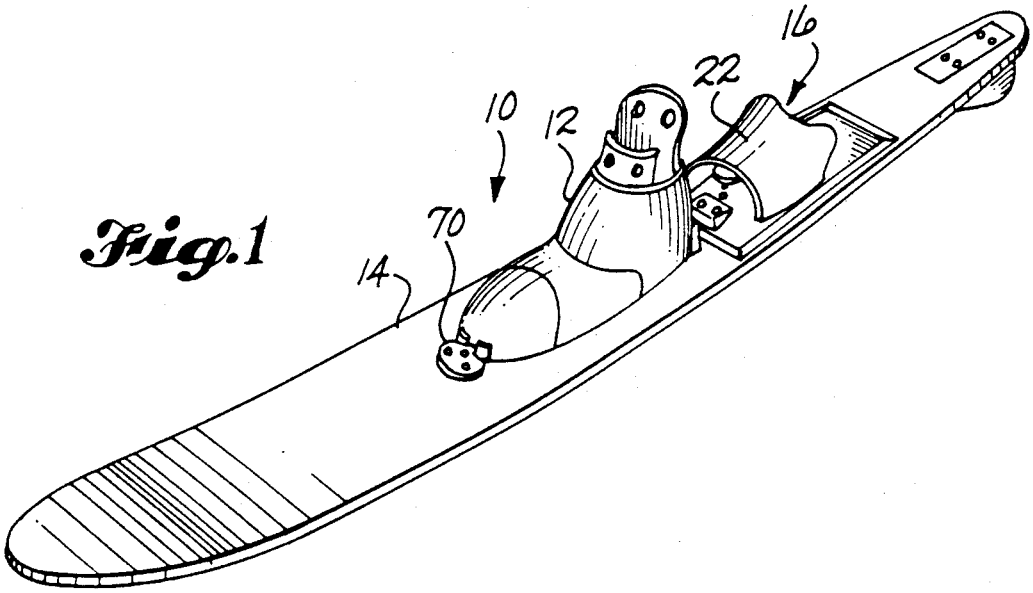
FIG. 1 is a perspective view of one embodiment of the invention.
Figure 2:
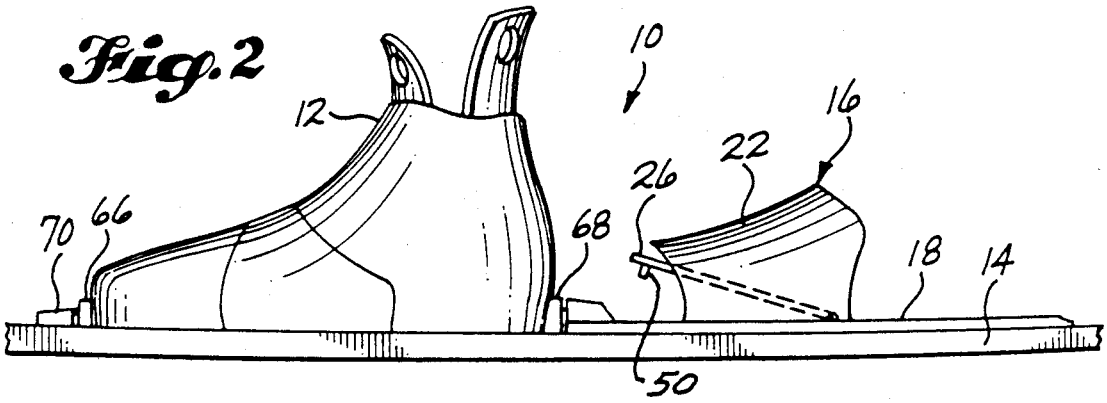
FIG. 2 is a side elevation.
Figure 3:
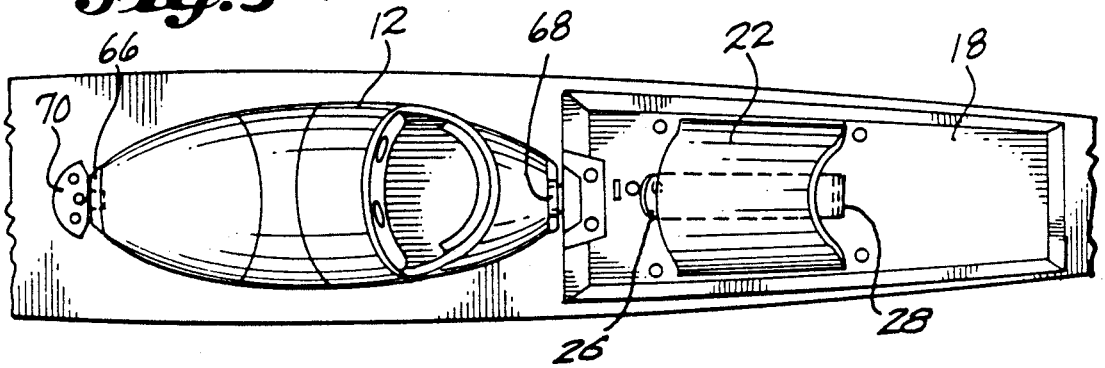
FIG. 3 is a plan of the embodiment of FIG. 1.
Figure 4:
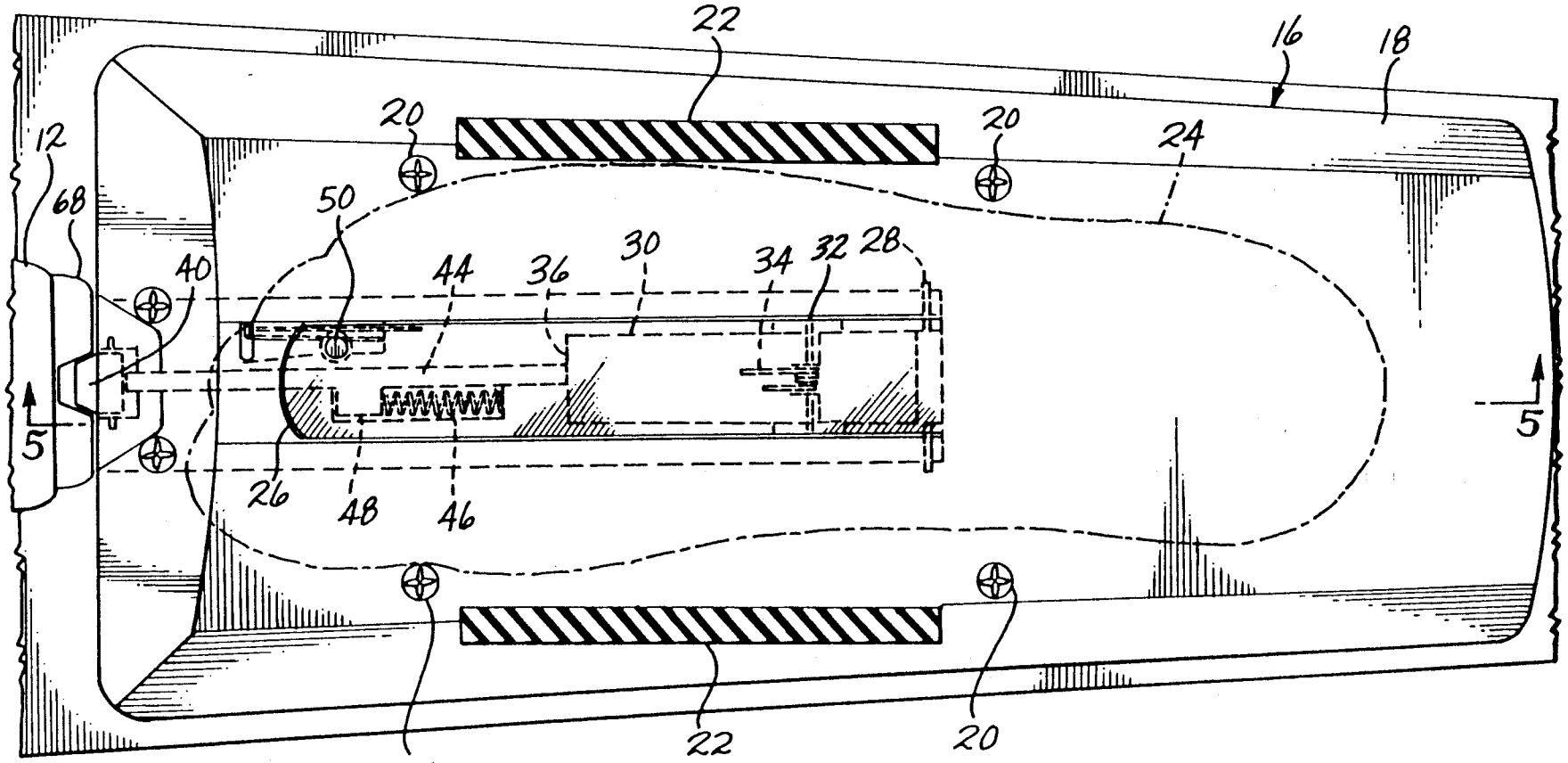
FIG. 4 is an enlarged plan of part of FIG. 3 with parts broken away.
Figure 5:
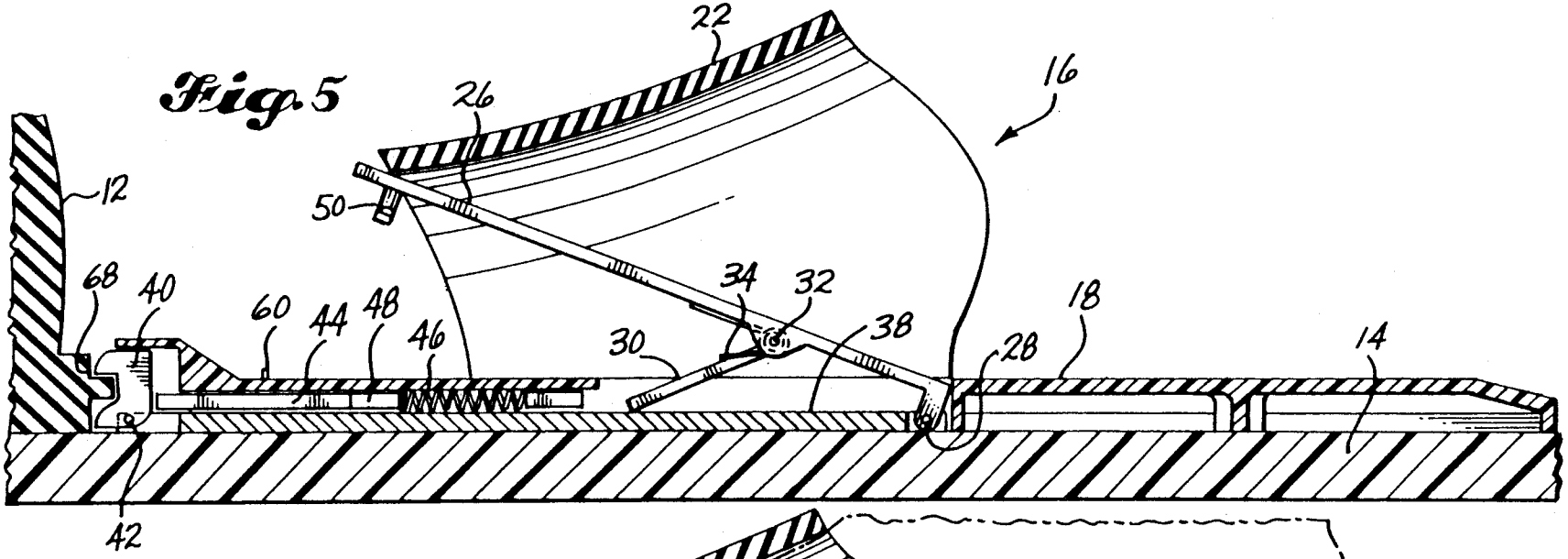
FIGS. 5 and 6 are longitudinal sections taken along line 5—5 of FIG. 4, FIG. 5 showing the binding in released position and FIG. 6 showing the binding in holding position with a foot in place.
Figure 6:
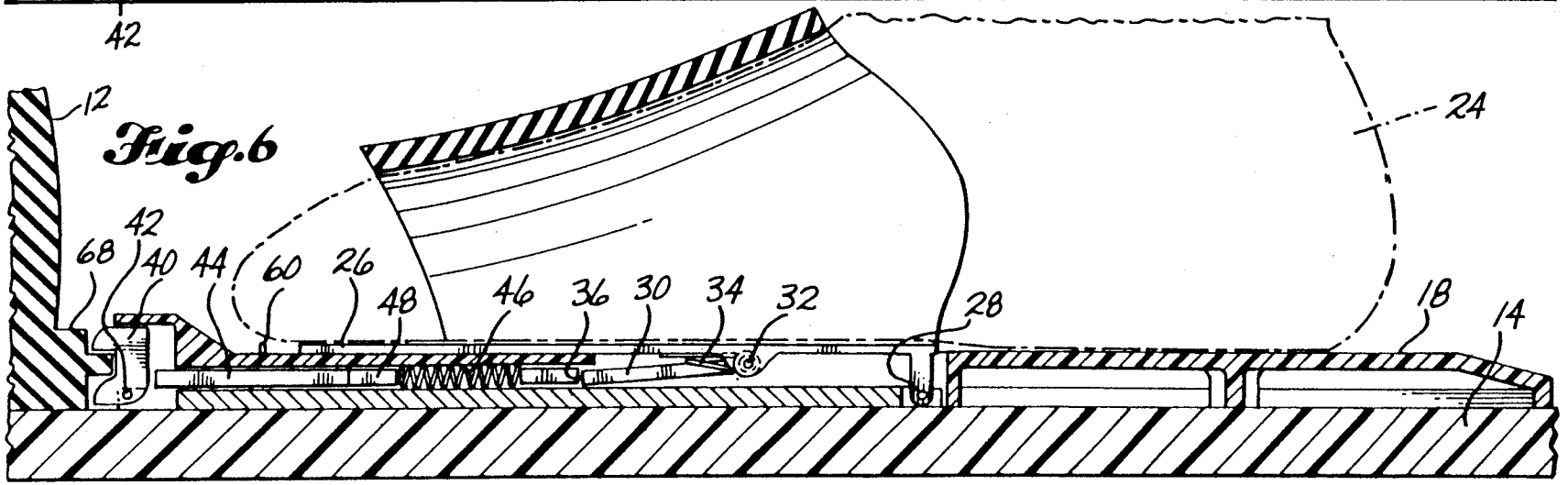

As shown in FIGS. 1, 2, 3, 13 and 14, a ski binding 10 has a foot-engaging member in the form of a foot-holding boot 12 for a front foot releasably mounted on a ski 14, shown as a water ski, and a rear foot-engaging member 16 on the same ski. The rear foot-engaging member has a base 18 secured to the ski with fasteners 20. A foot-holding instep strap 22 is secured to the base and is located to receive and hold the front portion of the rear foot 24 shown in broken lines in FIG. 4. A foot lever or pedal or treadle 26, shown in FIGS. 5 and 6 is pivotally mounted by pin 28 to the base 18 and extends forward from such pin. A thrust arm 30 beneath the treadle 26 has its rearward end pivotally mounted by pivot pin 32 to the underside of the treadle. A torsion spring 34 is mounted on pin 32 in a manner to swing treadle 26 upward due to the end 36 of the thrust arm 30 pressing against the upper surface 38 of base 18 when there is no downward pressure by the foot 24 against the treadle.

Figure 7:
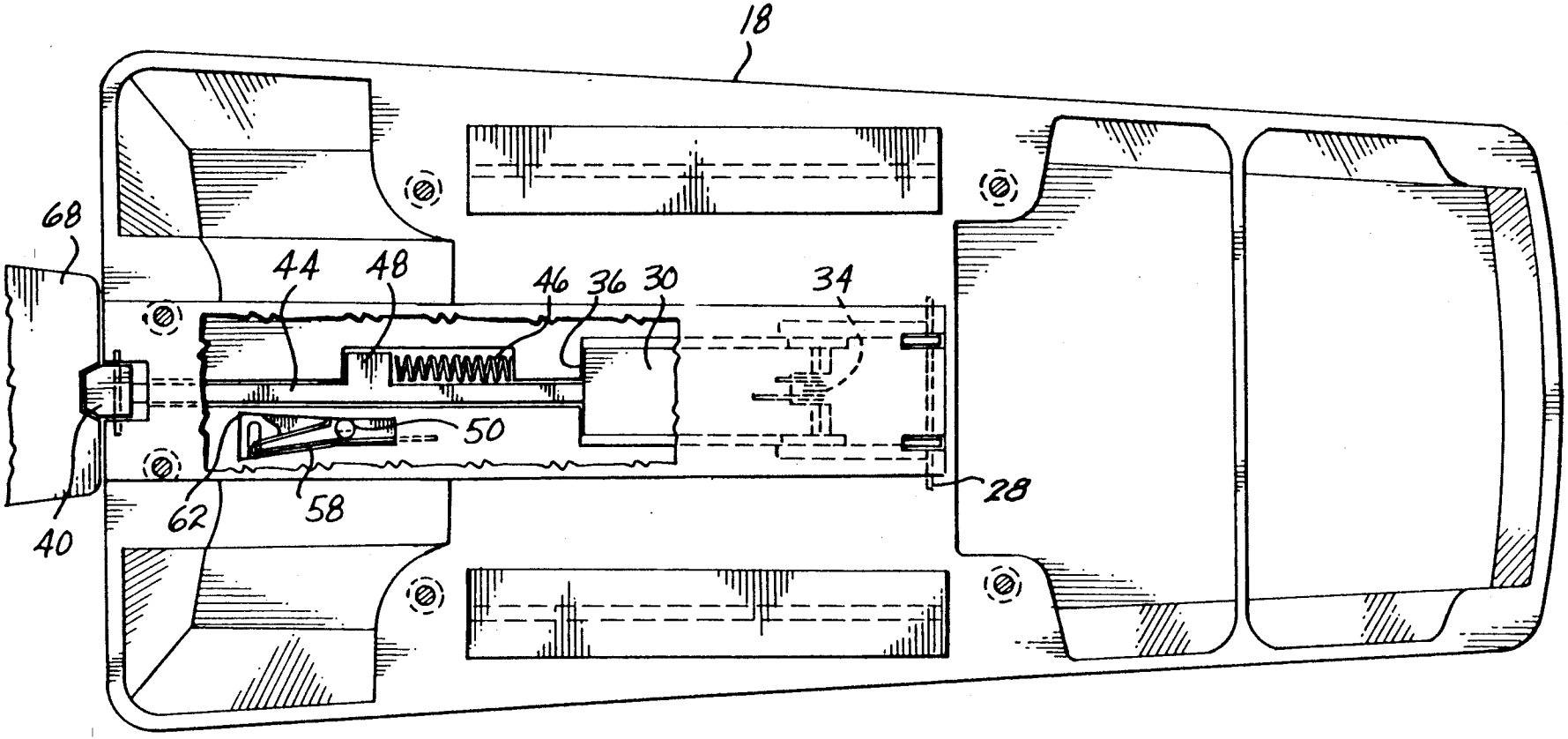
FIG. 7 is a bottom plan of FIG. 4 with parts broken away.

A latch hook keeper 40 is pivotally mounted by pin 42 to the front end of base 18 so as to be held against translation lengthwise of the ski. In its forwardly swung position the hook of such keeper will engage a projection 68 carried by the heel of front boot 12 to hold such heel to the ski. A slide bar 44 is slidably mounted on the base and is located and is of a length to extend between the latch hook keeper 40 and the forward end 36 of thrust arm 30 to hold the keeper positively in forwardly swung latching position when the treadle 26 is held down as shown in FIG. 5 such as by the rear foot inserted under instep strap 22. A weak helical compression spring 46 is mounted between base 18 and a projection 48 extending laterally from slide bar 44, as shown in FIG. 7, to urge such bar forwardly against latch hook keeper 40 when it is not held positively by slide bar 44, as shown in FIG. 5. Lifting of the heel of the forward boot 12 when the keeper is not positively held in latched position would cause heel projection 68 to lift the hook of such keeper and swing the keeper rearward from the position shown in FIG. 5 into released or unlatched position, shifting slide 44 rearward in opposition to the force of spring 46 since such slide movement is not blocked by thrust arm 30 as in the position of FIG. 6.

The forward end of treadle 26 has beneath it a downwardly extending boss 50, best shown in FIGS. 9 through 12. That boss has a flaring notch 52 in a lateral side of its lower end portion shown best in FIG. 10. A return bent resilient keeper or latch wire 54 is received in a recess 56 of the base 18 and has a longer latch leg 58 extending alongside the notch 52 in boss 50 and a shorter leg 62. The return bent portion of wire 54 is bent upward at a right angle to the coplanar legs 58 and 62 to form a projection 60 extending upward above the base 18. The shorter leg 62 of the wire presses against the side of the recess 56 adjacent to the side of boss 50 opposite notch 52 so as to act as a spring for moving the longer wire latch leg 58 away from the notch 52 in the boss 50.

When the treadle 26 is pressed down manually nearly to the base 18 the upwardly extending projection 60 of the wire may be moved manually toward the boss 50 as indicated in FIG. 9 to insert the latch leg 58 into the notch 52 of the boss for latching the treadle 26 in its lower position. If the treadle is then released the latch wire leg 58 will be held frictionally in the notch 52 as shown in FIG. 9 owing to the torsion spring 34 acting on the thrust arm 30 tending to swing treadle 26 upward. When the rear foot 24 is inserted beneath the instep strap 22 it will press the treadle 26 down slightly from its latched position, moving boss 50 down to wedge the wire leg 58 out of boss notch 52 to allow release of the boss. Consequently, when the foot 24 is withdrawn from beneath the instep strap 22, the treadle will be swung upward by spring 34 from the positive keeper-holding position shown in FIG. 6 to that of FIG. 5 in which upward force exerted by projection 68 of the front boot heel will unlatch the keeper 40 by swinging it rearward to release the front boot heel projection 68.

Figure 13:
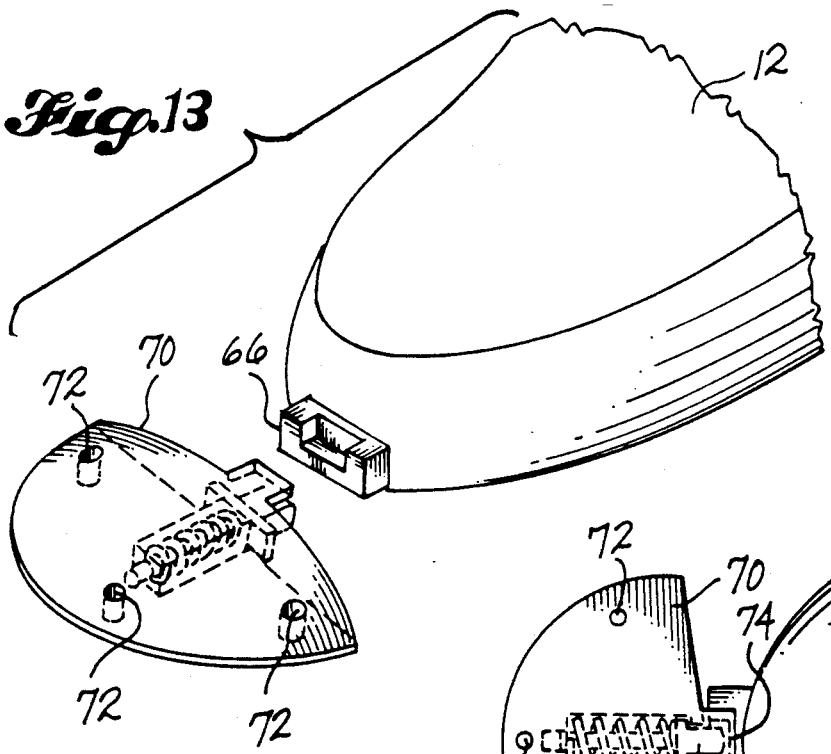
FIG. 13 is a top perspective view showing the front boot front hold-down with parts in exploded relationship.
Figure 14:
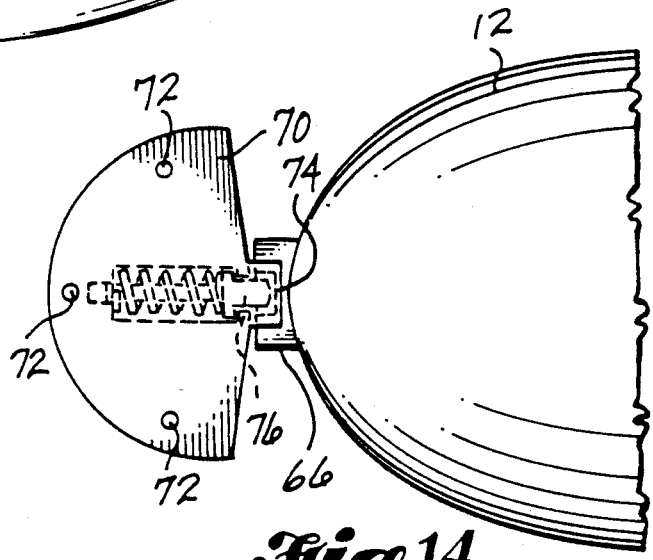
FIG. 14 is a plan of a boot front hold-down with parts in assembled relationship.
Figure 15:
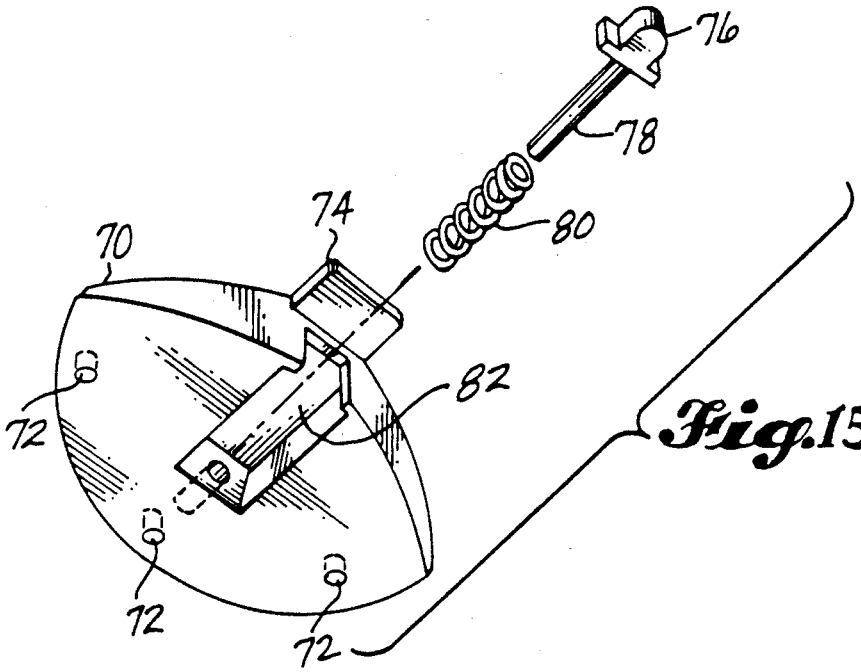
FIG. 15 is a bottom perspective view of a boot front hold-down showing parts in exploded relationship.
Figure 16:
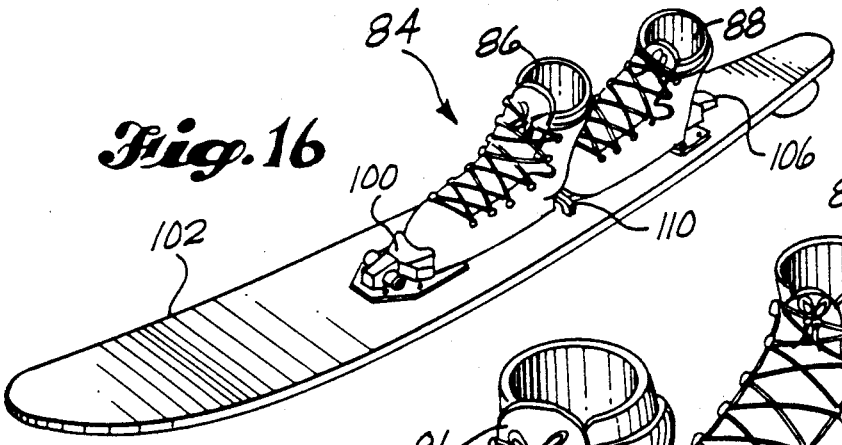
FIG. 16 is a top perspective view of a second embodiment of the invention.
Figure 17:
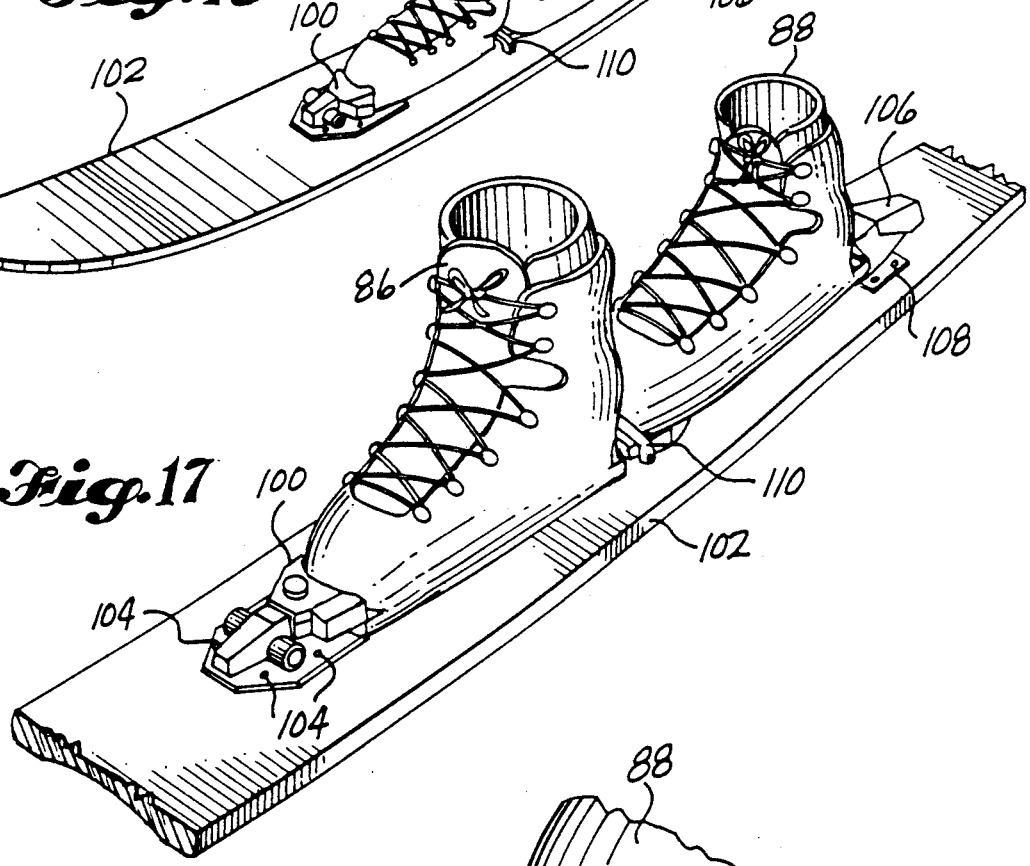
FIG. 17 is an enlarged top perspective view of a portion of the invention shown in FIG. 16.
Figure 18:
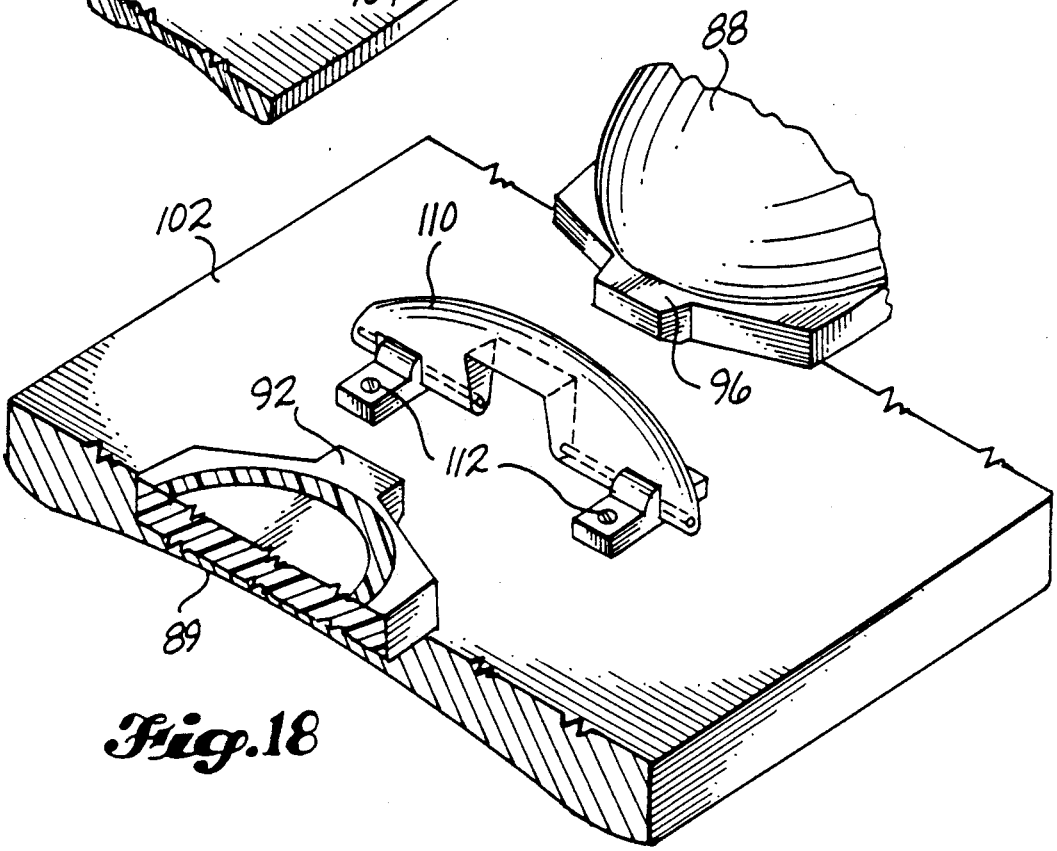
FIG. 18 is a further enlarged fragmentary top perspective view showing details of the connection between boots with parts in exploded relationship.
Figure 19:
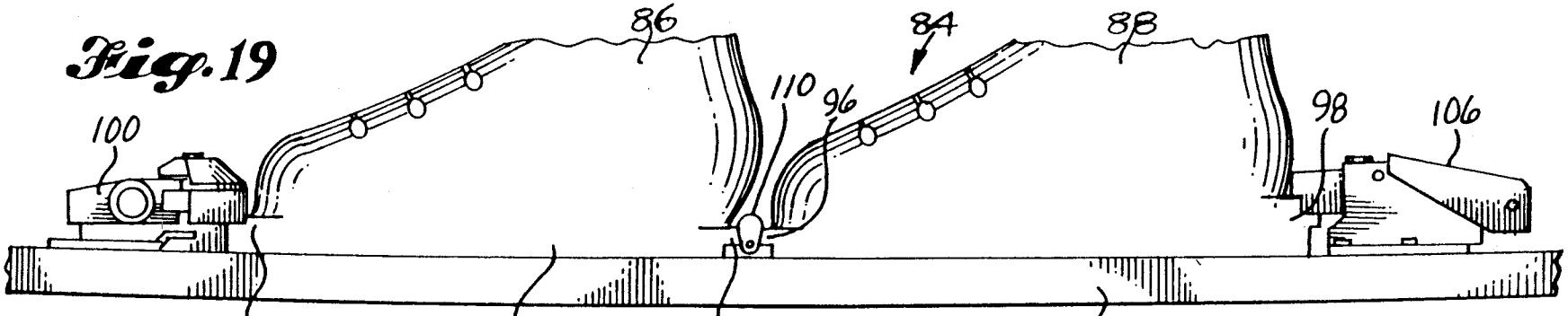
FIG. 19 is a side elevation of the embodiment of the invention shown in FIG. 17 with parts broken away.

The forward end of boot 12 may be secured to the ski as shown in FIGS. 13, 14 and 15 by a recessed forward end projection 66 engaging a holding member 70 secured to the ski by fasteners extending through holes 72. Such holding member has a rearward projection 74 shaped to fit into the recess of the boot toe projection to hold the toe of the boot in place. Projection 74 overlies a plunger having a head 76 mounted on a rod 78 which extends through a compression spring 80. The plunger and spring are housed in a recess 82 in the holding member 70 and the rod head 76 is located to press against the boot forward end projection 66 beneath the recess into which projection 74 fits for pressing the boot rearward to maintain the heel projection 68 in position for latching engagement by the hook of keeper 40 as the ski flexes beneath the boot during use.

As shown in FIG. 7, the sides of the latch hook of keeper 40 are beveled and a notch in boot heel projection 68 is complementally flared to hold the boot heel in place when the keeper is held in its forwardly swung position. Wedging engagement of the beveled surfaces enables a sidewise thrust of the boot heel to release the latch if such thrust is great enough.

In order to prepare the ski for skiing, the toe of the boot 12 with the front foot in it is secured to the ski by the holding member 70, projection 72 being inserted into the recess in the boot toe projection 66. Next the treadle 26 is manually pressed down against the base to latch the heel of the front foot boot and projection 60 of the return bent wire 54 is manually pressed sidewise to move latch leg 58 of the wire into notch 52 of the boss 50 where it remains when the treadle is released because the resilient upward pressure of thrust arm 30 effected by the torsion spring 34 holds wire leg 58 in the notch 52. Such engagement of the wire leg in the boss notch latches the treadle 26 in its down position with the thrust arm 30 holding slide bar 44 against keeper 40 to maintain it in its forwardly swung position latching the boot rearward projection 68 to the ski.

The most convenient method of using the ski is to secure the front foot boot 12 to the ski as described above, start skiing, and then to insert the rear foot under the instep strap 22. Upon movement of the treadle 26 from its latched position slightly farther downward by pressure of the rear foot on it the treadle boss 50 wedges wire leg 58 sidewise out of the notch 52 so that the treadle 26 is set to be moved upward by pressure of thrust arm 30 whenever the rear foot is removed from beneath the instep strap.

Should the rear foot be separated from the ski, such as from a fall of the skier, the spring 34 swings thrust arm 30 and treadle 26 apart, raising the treadle, which retracts the thrust arm 30 rearward away from the boot 12, enabling the latch keeper 40 to be swung away from the boot by upward pressure on its hook of heel projection 68 for releasing the heel of boot 12. Such release enables the boot heel to be lifted so that the toe projection 66 can move away from the holding member 70, thus completely freeing the boot from the ski.

In a second embodiment of the invention, shown in FIGS. 16 to 25, a ski binding 84 includes a forward boot 86 and a rearward boot 88. The forward boot has a forwardly extending toe projection 90 and a rearwardly extending heel projection 92. The rearward boot has a forwardly extending toe projection 96 and a rearwardly extending heel projection 98. A releasable hold-down keeper unit 100 engageable with the forward boot toe projection 90 is secured to the ski 102 by fasteners 104. This unit is shaped and located to receive the toe projection 90 for holding the toe of the forward boot to the ski. Behind the rearward boot heel is another releasable hold-down keeper unit 106 of conventional type secured to the ski by fasteners 108 in a position to receive heel projection 98 to hold the heel of the rearward boot to the ski.

Figure 20:
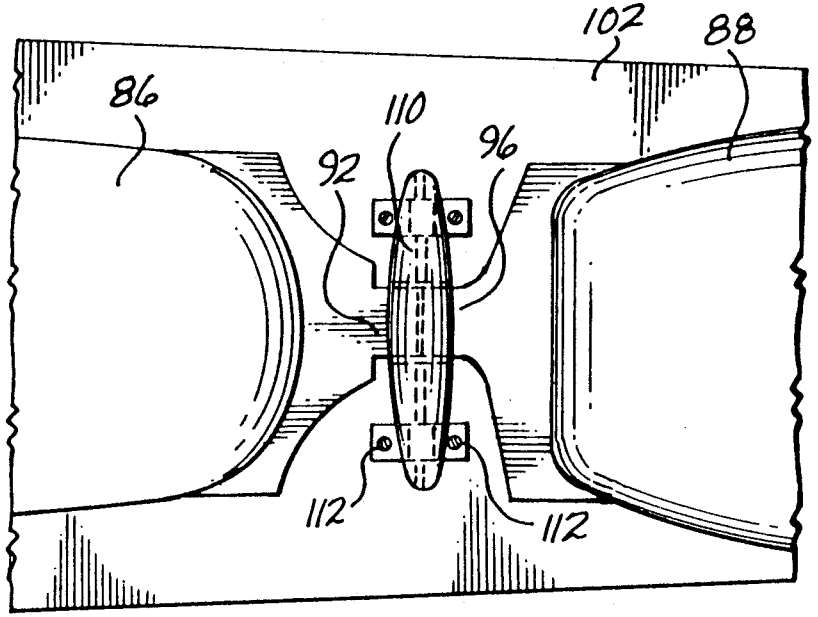
FIGS. 20 and 21 are detailed enlarged plans showing the keeper arrangement of FIG. 18 for forward and rearward boots, FIG. 20 showing the keeper in boot-retaining condition, and FIG. 21 showing the keeper in boot-released condition.
Figure 21:
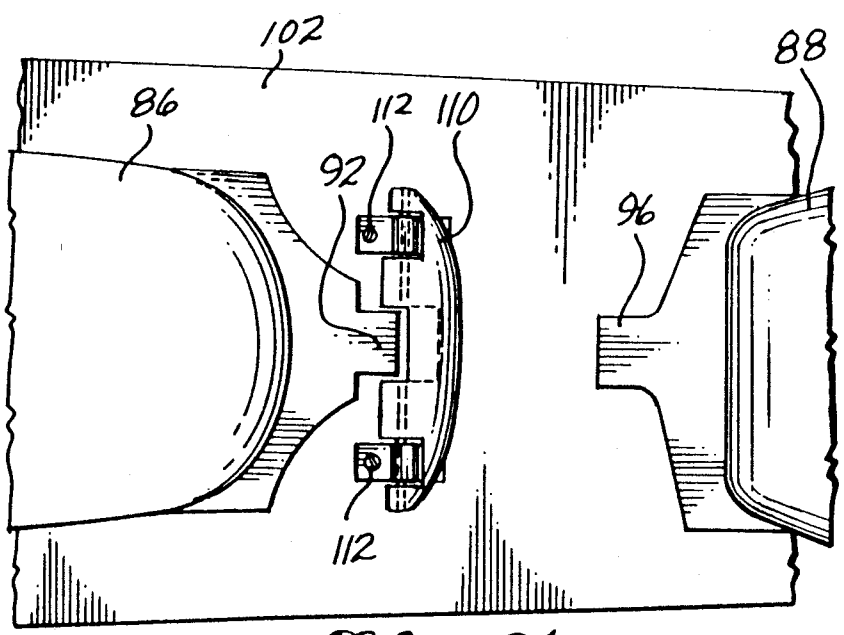
Figure 22:
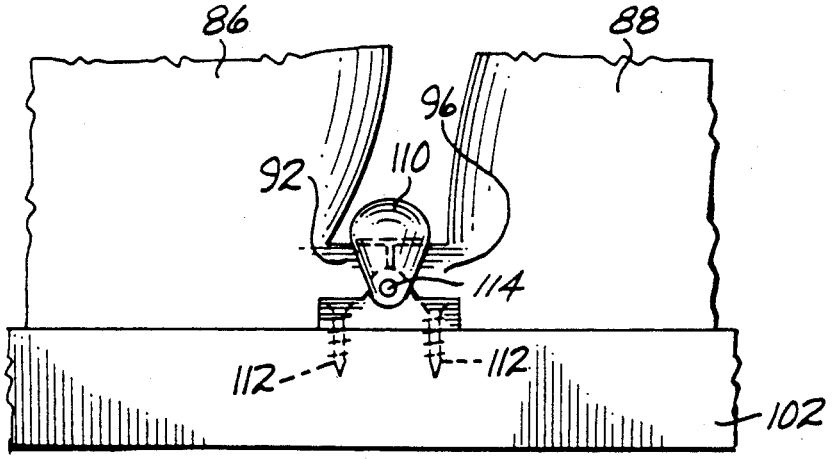
FIG. 22 is a side elevation of the keeper as shown in FIG. 20 on a large scale.

Between the heel of the forward boot 86 and the toe of the rearward boot 88 is a coupling loop or bail keeper 110, pivotally mounted by pin 114 and secured to the ski with rivet, screw or bolt fasteners 112 so as to be held against translation lengthwise of the ski. This coupling loop or bail can embrace both the heel projection 92 of the forward boot and the toe projection 96 of the rearward boot simultaneously as best shown in FIGS. 20 and 22, which projections constitute blocking means restraining swinging of the keeper bail 110 about its pivot 114 either forward or backward.

Figure 23:
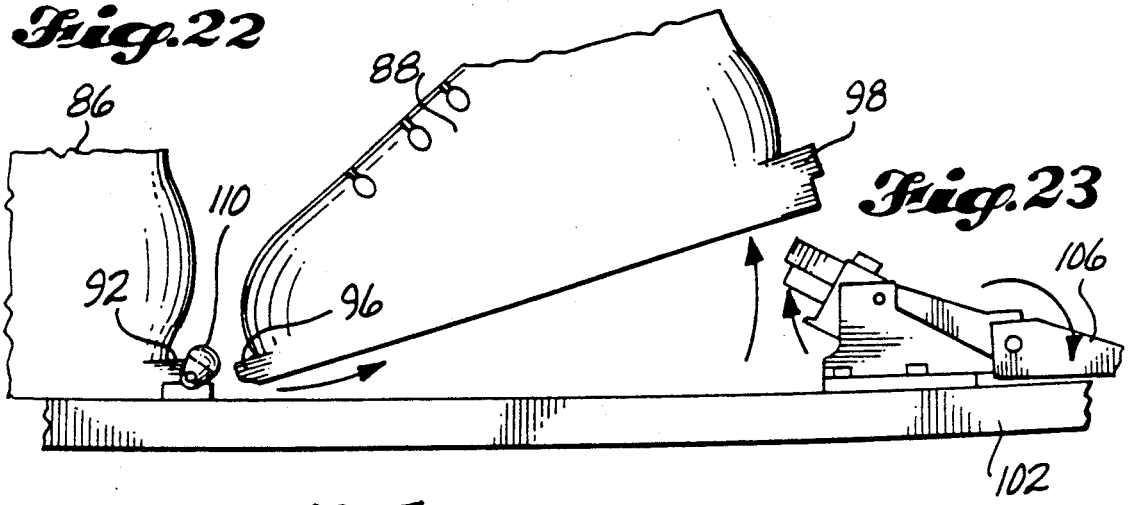
FIG. 23 is a side elevation of the keeper, similar to FIG. 19 but showing the rearward boot in releasing position similar to FIG. 21.
Figure 24:
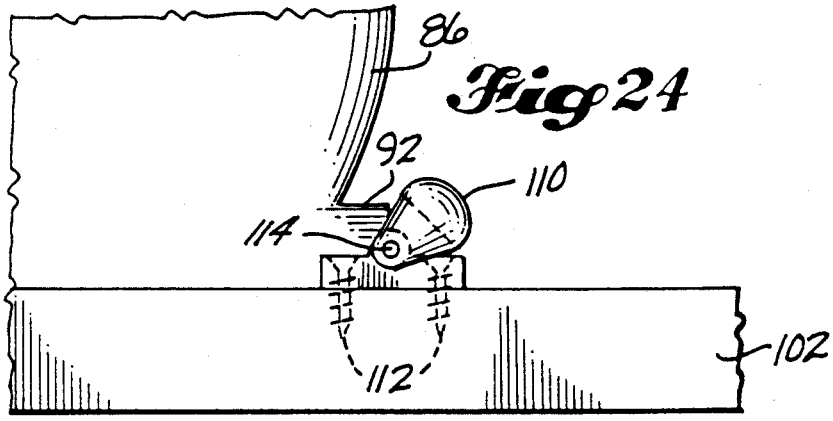
FIG. 24 is an enlarged side elevation of a portion of FIG. 23.
Figure 25:
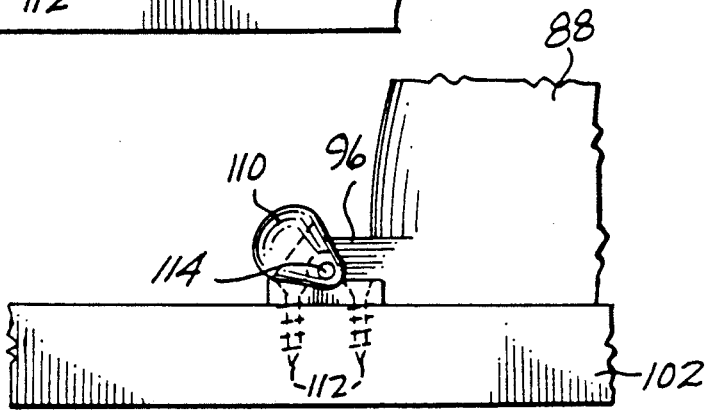
FIG. 25 is an enlarged side elevation similar to FIG. 24, but with the forward boot omitted and the rearward boot being released.
Figure 26:
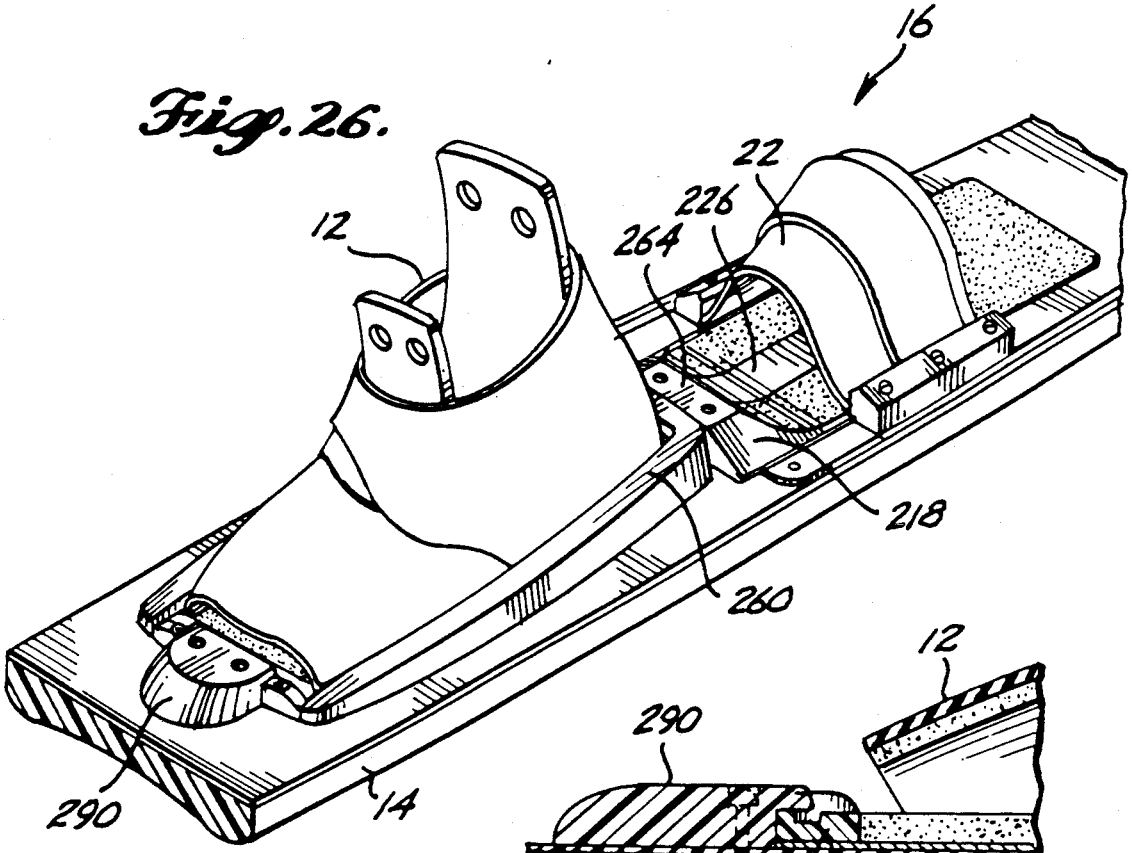
FIG. 26 is a top perspective view of a third embodiment of the invention, parts being broken away.
Figure 27:
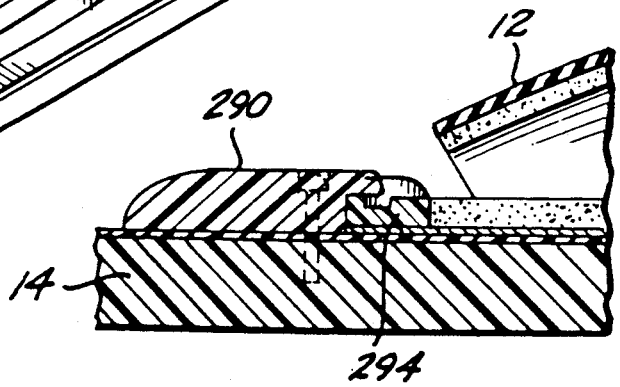
FIG. 27 is a longitudinal section through the forward portion of the invention shown in FIG. 26 with parts in assembled relationship.
Figure 28:
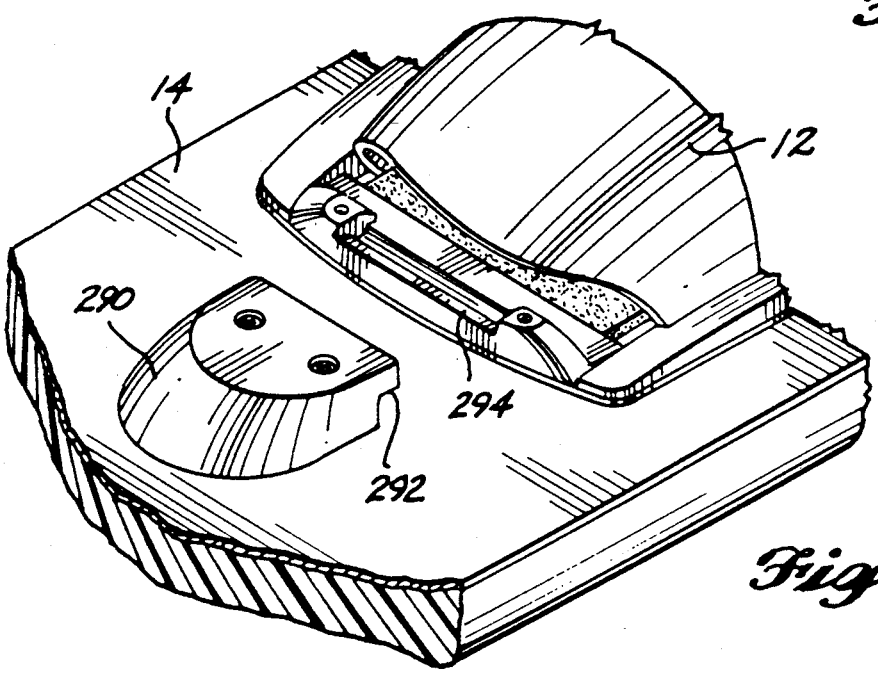
FIG. 28 is a top perspective view of the same portion of the invention with parts in separated relationship.
Figure 33:
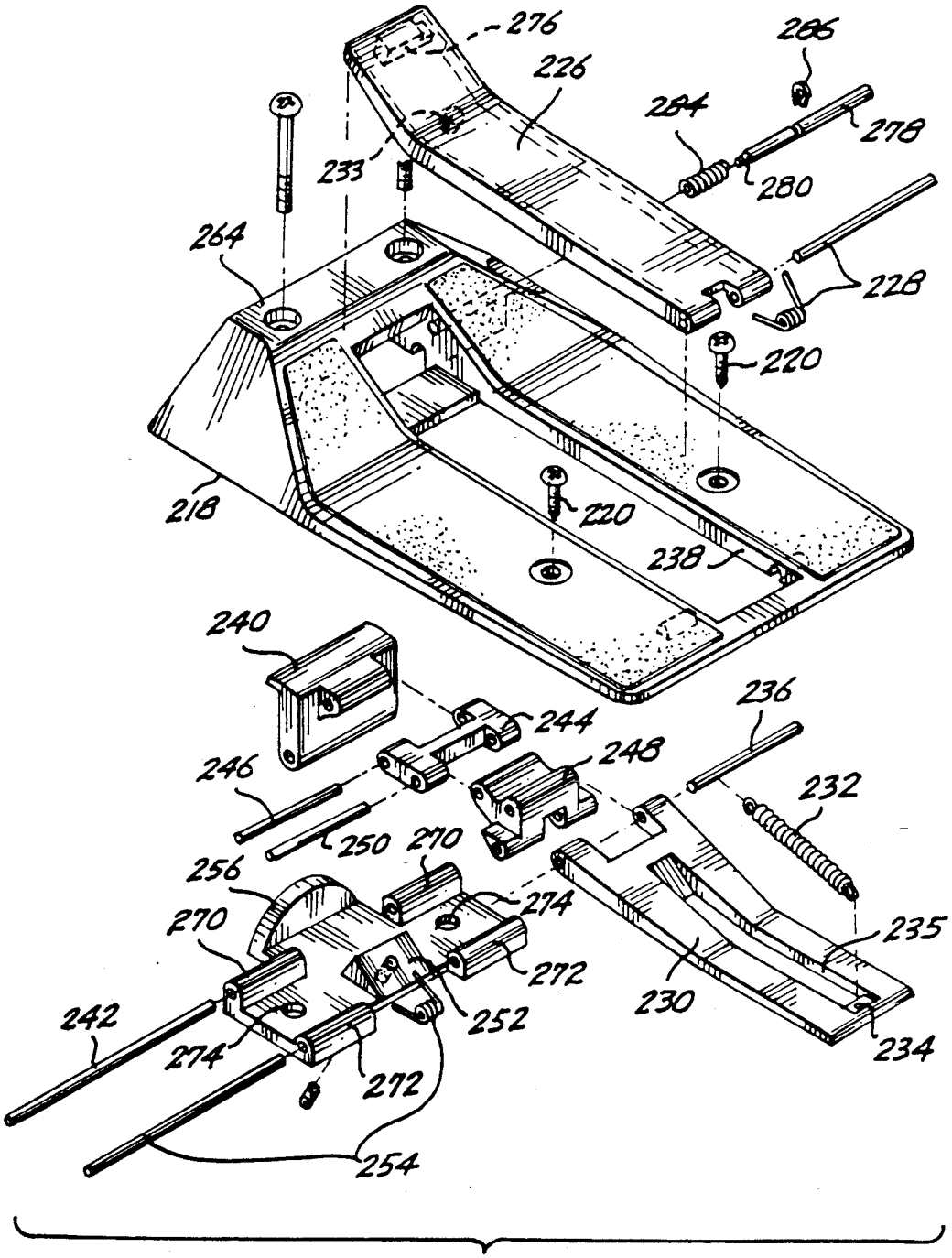
FIG. 33 is a top perspective view of one component of the third embodiment of the invention shown in FIGS. 29, 30 and 31 with parts in exploded relationship.

Should the rearward boot 88 be released by excessive force being exerted on the releasable keeper unit 106 holding the boot heel, as shown in FIG. 23, the rearward boot will move rearwardly away from the forward boot withdrawing the blocking projection 96 carried by the rearward boot from beneath the loop or bail 110, uncoupling the boots and enabling the loop or bail keeper to swing rearward about its pivot 114, as best shown in FIG. 24. Such rearward swinging will disengage the bail 110 from the heel projection 92 of the forward boot, enabling the heel of the forward boot to be lifted and the toe projection 90 to be pulled rearward from the hold-down keeper 100 to release the forward boot from the ski.

To prepare the ski for use, the forward boot 86 with the front foot in it is placed with its toe projection 90 inserted into forward hold-down keeper 100 and the bail keeper 110 is swung forward to cover heel projection 92. Next, toe projection 96 of the rearward boot 88 is inserted under the loop or bail keeper 110 to block rearward swinging of the bail and the rearward boot rear hold-down latch 106 is swung to engage and hold the heel projection 98 of the rearward boot 88. Both boots 86 and 88 will then be held to the ski.

When in skiing the skier exerts excessive force on the forward boot 86 the toe hold-down 100 of that boot will release. If excessive force is exerted on the rearward boot, the hold-down keeper 106 for the rearward boot heel will be released. The released boot will pull away from the ski to withdraw the corresponding blocking projection 92 or 96 from under the coupling loop or bail keeper 110. Such keeper will immediately swing away from the projection of the other boot remaining under it to release that projection also so as to release such other boot from the ski.

The function of the third embodiment of the invention shown in FIGS. 26 through 37 is similar to that of the first two embodiments described above, and the structure of the third embodiment is more similar to that of the first embodiment shown in FIGS. 1 through 15 than it is to the second embodiment of the invention shown in FIGS. 16 through 25 in that, while the holder for the front foot is a boot 12, the holder 16 for the rear foot is primarily an instep strap 22.

The holder 16 for the rear foot includes a base 218 held to the ski 14 by screws, rivets or other fasteners 220. Beneath the instep strap 22 is a treadle 226 pivoted to the base 218 by a torsion spring hinge 228 urging the treadle to swing upward. A thrust arm 230 beneath the treadle has its rearward end operably connected to the central portion of the treadle by the rearward end of the thrust arm sliding in ways in the underside of the treadle and urged away from the treadle hinge 228 by a helical tension spring 232 connected between a lug 233 projecting downward from the underside of the treadle 226 and an aperture 234 in the rearward end of the thrust arm 230 and pulling such sliding end of the thrust arm toward 230 the swinging end of the treadle. Such spring is received in slot 235 in such thrust arm shown in FIG. 33.

The forward end of the thrust arm 230 is connected by a pivot 236 to keeper or latch-actuating mechanism. The thrust arm 230 will fold beneath the treadle 226 as the treadle is swung downward so that the folded treadle and thrust arm are received in a slot 238 in the base 218, as shown in FIG. 30.

The keeper or latch interengageable between the rear portion of the front foot holder 12 and the forward portion of the rear foot holder includes a latch hook keeper 240, the lower end of which is mounted on the ski by a pivot 242. Such keeper is swung about its pivot by a toggle joint including a link 244 connected to the keeper by a pivot 246. The other link of the toggle joint is a bell crank 248 to which the forward end of the thrust arm 230 is connected by pivot 236. The two links 244 and 248 of the toggle joint are connected together by pivot 250. The toggle joint is mounted on a keeper base 252 by the latch hook pivot 242 and a torsion spring hinge 254 mounting the lower end of the bell crank 248 and urging such bell crank to swing rearward.

A lug 256 is mounted on and projects upward from the forward end of the keeper base 252 for engagement in a downwardly opening socket 258 in the heel portion of the mounting 260 for the front boot 12. A ledge projection 262 projects rearward from the mounting, as shown in FIGS. 29 and 31, for latching engagement by the hook of keeper 240 when the toggle joint 244, 248 is extended from the condition shown in FIG. 29 to that shown in FIG. 30.

Downward movement of treadle 226 will force thrust arm 230 to the left from the position shown in FIG. 29 to the position shown in FIG. 30. Such lengthwise movement of the thrust arm will swing bell crank 248 counterclockwise from the position of FIG. 29 to that of FIG. 30, overcoming the force of torsion hinge 254 tending to swing bell crank 248 rearward, which will extend the toggle linkage causing link 244 to swing keeper 240 counterclockwise until its hook engages the ledge 262 of projection 260 in latched condition, as shown in FIG. 30. The keeper will be maintained in such latched position as long as the rear foot remains beneath the instep strap 22 for holding treadle 226 in its down position.

The forward end portion of the treadle 226 is bent upward so that when the treadle is swung downward by the rear foot pressing on it as it is inserted under the instep strap 22 to the position shown in FIG. 30, the upwardly inclined forward portion of the treadle will be faired into the rearward portion of the housing 264 overlying and shielding the keeper-actuating linkage. As shown in FIG. 34, the underside of the housing 264 has in it a central recess 266 for receiving the keeper 240 and its actuating toggle joint, as shown in FIGS. 29 and 30. Shallower recesses 268 at opposite sides of the central recess 266 receive the front and rear bosses 270 and 272 of the keeper base 252, as indicated in FIG. 34. The keeper base 252 can be anchored in place by bolts extending downward through the housing 264 and through apertures 274 shown in FIG. 34 between the bosses 270 and 272.

A latch is provided to hold the treadle 226 down substantially in the position shown in FIG. 30 prior to insertion of the rear foot beneath the instep strap 22. Such latch mechanism is shown best in FIGS. 29, 30, 35 and 36 as including a boss 276 projecting downward from the forward portion of the underside of treadle 226. When the treadle is in its down position shown in FIG. 30, a latch pin 278 slidable transversely through a bore in base 218 is aligned with such boss. The tip 280 of such latch pin adjacent to boss 276 can fit into a socket 282 in the side of the boss when the latch pin is slid from the unlatched position shown in FIG. 36 to the latched position shown in FIG. 35. A helical compression spring 284 encircling the latch pin and reacting between an abutment 286 on the latch pin, such as a washer welded to the pin or a pin extending through a transverse aperture in the latch pin and the wall 288 of a cavity in the housing through which the latch pin extends normally urges the latch pin into the unlatched position of FIG. 36. The latching tip 280 of the latch pin can be engaged in the boss socket 282 by manual pressure on the outer end of the latch pin sufficient to overcome the force of spring 284 and slide the latch pin from the position shown in 36 to that of FIG. 35.

In using the ski, the treadle 226 is depressed manually from the broken line position shown in FIG. 36 to the solid line position in opposition to the force of torsion spring hinge 28 tending to swing the treadle upward. The latch pin 278 is then pressed manually to the right, as seen in FIG. 36, until the latching tip 80 engages in treadle boss socket 82, as shown in FIG. 35. If the manual pressure on the treadle is then released and the latched pin is released, the friction between the latch pin tip 280 and the socket 282 will maintain the latch pin 278 in the position slid to the right, as shown in FIG. 35, and the treadle 226 in its down position.

The skier can by such manual depression of the treadle before inserting place his front foot in the boot 12 and secure the boot to the ski and insert his rear foot under the instep strap 22. By such insertion of the rear foot 24 under the instep strap, as indicated in FIG. 30, pressure will be exerted on the treadle 226 to swing it downward slightly farther so that the treadle boss socket 282 no longer presses upwardly against the tip 280 of the latch pin. Spring 284 will then function to retract latch pin 278 from the position shown in FIG. 35 to the position shown in FIG. 36, but the unlatched treadle will still be held in the lower position of FIG. 30 by the pressure on it of the rear foot inserted under the instep strap 22.

Figure 37:
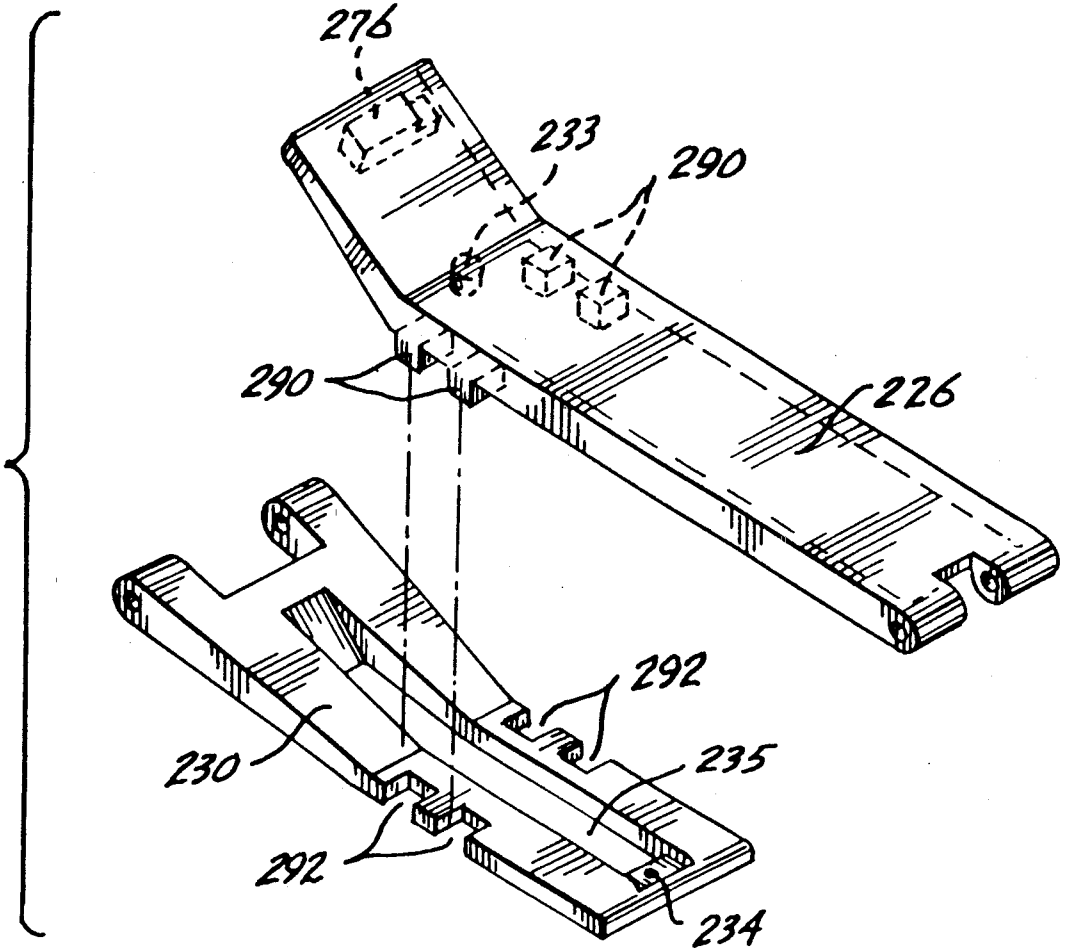
FIG. 37 is a top perspective view of a portion of the third embodiment of the invention shown in FIGS. 29 and 30 showing a modification with parts in exploded relationship.

If the skier should withdraw his rear foot 24 from beneath the instep strap 22, the unheld and unlatched treadle 226 will be swung upward by its spring hinge 228 from the position shown in FIG. 30 to the position shown in FIG. 29 to relieve the thrust force of thrust arm 230 toward the left, as seen in FIGS. 29 and 30, on bell crank 248. The torsion spring hinge 254 of the bell crank will then swing it in a clockwise direction to contract the toggle joint 244, 248 and swing keeper 240 in a clockwise direction to withdraw its hook from engagement with ledge 262 of the forward boot heel projection 260 Such projection will thus be unlatched so that the front boot is free to be withdrawn from the ski FIG. 37 shows a modification of the treadle 226 and the thrust arm 230 The modified construction of the treadle and thrust arm is provided to insure that the skier knows when the heel of the front boot is latched to the ski. The treadle and thrust arm must be in a predetermined relationship to enable the treadle to be swung from its upper position shown in FIG. 29 to its down position shown in FIG. 30 for engagement of the hook of keeper 240 with the ledge 262 of the front boot heel projection. Such modified structure includes lugs 290 projecting downward from opposite edge portions of the treadle 226 in position for engagement in socket notches 292 in the opposite edge portions of the thrust arm 230. If the lugs 290 on the treadle 226 do not fit into the socket notches 292 of the thrust arm the treadle and thrust arm cannot be folded together alerting the skier to the fact that the keeper 240 is not latching the heel projection of the front boot.

We claim:

1. A releasable ski binding for holding a skier's two feet in tandem arrangement on a single ski comprising a boot for retaining one of the two feet, means for holding one end of said boot to the ski, a keeper, pivot means held against translation lengthwise of the ski and pivotally mounting said keeper on the ski adjacent to the other end of said boot for swinging into engagement with such other end of said boot for holding it to the ski and away from such other end of said boot for releasing it from the ski, an instep strap secured to the ski for insertion of the other of the two feet therebeneath to hold such other of the two feet to the ski, and means operable automatically in response to removal of the other of the two feet from beneath said instep strap for enabling release of said keeper by swinging thereof away from such other end of said boot to free said boot from the ski.

2. The ski binding defined in claim 1, in which the means operable automatically in response to removal of the other of the two feet from beneath the instep strap includes a treadle located under the instep strap and operatively connected to the keeper to hold it in boot-retaining condition when a foot is inserted beneath the instep strap and to release the keeper when the foot is removed from beneath the instep strap.

3. The ski binding defined in claim 2, in which the means operable automatically in response to removal of the other of the two feet from beneath the instep strap further includes a thrust arm interengaged between the treadle and the keeper extending lengthwise of the ski and movable lengthwise of the ski by swinging of the treadle relative to the ski.

4. The ski binding defined in claim 3, in which the means operable automatically in response to removal of the other of the two feet from beneath the instep strap further includes linkage connected between the keeper and the forward end of the thrust arm.

5. The ski binding defined in claim 4, in which the linkage includes a toggle joint.

6. The ski binding defined in claim 5, in which one component of the toggle joint is a bell crank pivotally connected to the forward end portion of the thrust arm.

7. The ski binding defined in claim 2, and latch means for holding the treadle swung downwardly relative to the ski to hold the keeper in boot-retaining condition and releasable by pressure exerted downward on the treadle by insertion of a foot beneath the instep strap.

8. The ski binding defined in claim 7, in which the treadle has a boss projecting downward from its forward portion engageable with the latch means.

9. The ski binding defined in claim 8, in which the boss has a socket in one side thereof and the latch means includes a pin engageable in said socket.

10. The ski binding defined in claim 9, in which the latch means includes a spring urging the pin out of the boss socket for releasing the boss.

11. A releasable ski binding for holding a skier's front foot and rear foot in tandem arrangement on a single ski, comprising a forward boot, rear foot-engaging means including an instep strap secured to the ski rearward of said forward boot, holding means releasably attaching the toe of the said forward boot to the ski, a keeper, pivot means held against translation lengthwise of the ski pivotally mounting said keeper adjacent to the heel of said forward boot, said keeper when in position swung forwardly about said pivot means releasably holding the heel of said forward boot to the ski, blocking means held by the rear foot inserted under said instep strap for maintaining the keeper in position holding the forward boot heel, and means for automatically relieving the pressure of said blocking means for enabling said keeper to swing rearwardly about said pivot means for releasing the forward hoot held when the rear foot is removed from beneath said instep strap.

12. A releasable ski binding for holding a skier's two feet in tandem arrangement on a single ski, comprising a boot to hold one of the two feet, a releasable retainer for holding one end of said boot to the ski including spring means, a thrust arm positioned to stress said spring means for holding said retainer in boot-holding condition, and means actuatable automatically in response to removal of the other of the two feet from the ski for moving said thrust arm in the direction away from said boot and thereby relieving the stress of said spring means to enable release of said retainer from the boot end held thereby.

13. A releasable ski binding for holding a front foot and a rear foot of a skier in tandem arrangement on a single ski, comprising a boot for holding the front foot, a fastener mounted on the ski and engageable with the toe of said boot to secure the boot toe to the ski, a movable retainer engageable with the heel of said boot to secure the boot heel to the ski, an instep strap secured to the ski for receiving the rear foot therebeneath, means for holding said movable retainer to secure said boot to the ski by the rear foot inserted beneath said instep strap, and means for releasing said retainer to free said boot from the ski automatically in response to removal of the rear foot from beneath said instep strap.

14. The ski binding defined in claim 13, further including keeper means for holding the movable retainer in boot-securing position prior to insertion of the foot beneath the rear instep strap.

15. The ski binding defined in claim 13, in which the means for holding the movable retainer includes a treadle having its rearward end pivotally mounted on the ski and means interengaged between said treadle and the movable retainer for holding the movable retainer in boot-securing position when the treadle is depressed relative to the ski.

16. The ski binding defined in claim 15, and latch means for holding the treadle in depressed position prior to the rear foot being inserted beneath the instep strap.

17. The ski binding defined in claim 16, in which the treadle has a boss projecting downward from its forward portion engageable with the latch means.

18. The ski binding defined in claim 17, in which the boss has a socket in one side thereof and the latch means includes a pin engageable in said socket.

19. The releasable ski binding defined in claim 13, in which the means for holding the movable retainer includes a treadle having its rearward end pivotally mounted on the ski, a thrust arm swingably held to the underside of said treadle and operatively connected to the retainer for holding it in boot-holding condition, and the means for releasing the retainer includes spring means for swinging said treadle upward.

20. A releasable ski binding for holding a front foot and a rear foot in tandem arrangement on a single ski, comprising a boot for holding the front foot, fastener means mounted on the ski and engageable with the toe of said boot to secure said boot toe to the ski, a movable retainer engageable with the heel of said boot to secure the heel of said boot to the ski, an instep strap secured to the ski behind said boot for receiving the rear foot therebeneath, and means operable by the rear foot when received beneath said instep strap for holding said movable retainer in engagement with the heel of said boot and releasable when the rear foot is removed from beneath said instep strap to enable said moveable retainer to be disengaged from the heel of said boot to free it from the ski.

21. The ski binding defined in claim 20, in which the means operable by the rear foot includes a treadle and thrust means operatively interconnecting said treadle and the retainer.

22. The ski binding defined in claim 20, in which the movable retainer is pivotally mounted on the ski.

23. The ski binding defined in claim 8, in which the boss has a notch in one side thereof and the latch means includes a latch wire engageable in said notch.

24. The ski binding defined in claim 17, the boss projecting downward from the treadle having a notch in its side, and resilient keeper means engageable in said notch.

25. The ski binding defined in claim 13, further comprising means for pressing the boot rearward against the retainer.

26. The ski binding defined in claim 25, in which the fastener holding the toe of the boot includes the resilient means for pressing the boot rearward.

* * * * *

UNITED STATES PATENT AND TRADEMARK OFFICE

CERTIFICATE OF CORRECTION

PATENT NO. : 5,056,803

DATED : October 15, 1991

INVENTOR(S) : Roger C. Teeter and Lawrence C. Smith

It is certified that error appears in the above-identified patent and that said Letters Patent is hereby corrected as shown below:

Claim 11: column 9, line 50, cancel "hoot held" and insert --boot heel--.

Signed and Sealed this

Twenty-fourth Day of May, 1994

*Attest:*

Bruce Lehman

BRUCE LEHMAN

*Attesting Officer*

*Commissioner of Patents and Trademarks*